US012546563B2

(12) United States Patent
Magrath et al.

(10) Patent No.: US 12,546,563 B2
(45) Date of Patent: Feb. 10, 2026

(54) SENSOR MOUNT HOLSTER

(71) Applicant: Tedder Industries, LLC, Post Falls, ID (US)

(72) Inventors: Thomas Magrath, Dalton Gardens, ID (US); Randy Watts, Spokane, WA (US); Jacob Shearer, Moses Lake, WA (US)

( * ) Notice: Subject to any disclaimer, the term of this patent is extended or adjusted under 35 U.S.C. 154(b) by 152 days.

(21) Appl. No.: 18/534,617

(22) Filed: Dec. 9, 2023

(65) Prior Publication Data

US 2024/0191968 A1 Jun. 13, 2024

Related U.S. Application Data

(60) Provisional application No. 63/431,458, filed on Dec. 9, 2022.

(51) Int. Cl.
*F41C 33/02* (2006.01)

(52) U.S. Cl.
CPC ..... *F41C 33/029* (2013.01); *F41C 33/0236* (2013.01)

(58) Field of Classification Search
CPC ..... F41C 33/029; F41C 33/0236
See application file for complete search history.

(56) References Cited

U.S. PATENT DOCUMENTS

| | | | | |
|---|---|---|---|---|
| 6,267,279 | B1 * | 7/2001 | Matthews | F41C 33/0236 224/245 |
| 2016/0116253 | A1 * | 4/2016 | Moon | F41C 33/029 224/244 |
| 2016/0165192 | A1 * | 6/2016 | Saatchi | H04N 7/185 386/227 |
| 2017/0003101 | A1 * | 1/2017 | Madrid | F41C 33/029 |
| 2017/0016696 | A1 * | 1/2017 | Koskan | F41C 33/041 |
| 2018/0231349 | A1 * | 8/2018 | Wagner | F41C 33/04 |
| 2019/0049215 | A1 * | 2/2019 | Talbot | F41C 33/046 |
| 2019/0137215 | A1 * | 5/2019 | Bernkrant | F41C 33/0263 |
| 2023/0114957 | A1 * | 4/2023 | Alrakah | A61B 5/0022 224/243 |

* cited by examiner

*Primary Examiner* — Derek J Battisti

(57) ABSTRACT

A holster for an implement, such as a handgun, includes a holster body and a sensor mount integral to the holster body. The sensor mount has a mounting surface for mounting a sensor, an opening through the mounting surface to an interior of the holster body, and a sensor mount guide comprising a raised portion extending at least partially around a periphery of the mounting surface.

20 Claims, 4 Drawing Sheets

SENSOR MOUNT HOLSTER

PRIORITY CLAIM AND CROSS-REFERENCE TO RELATED APPLICATION

This application claims the benefit under 35 U.S.C. § 119(e)(1) of U.S. Provisional Application No. 63/431,458, filed Dec. 9, 2022, which is hereby incorporated by reference in its entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished.

In the case of a handgun, the holster should reasonably protect the handgun and the user, and should be convenient to the user for ready use. However, the holster should also be versatile enough to be comfortably carried by the user, such as when it is worn on the person of the user for an extended length of time. The holster should also be rigid and stable enough to allow the handgun to be repeatedly drawn and re-holstered, usually with the same hand.

Remote contact or communication with the holster or carrier (such as with transmission and reception of signals) can be convenient and desirable. However, remote contact and communication techniques can be problematic to implement on a holster, due to the often extreme nature of the environments holsters can be carried or worn into, and are often subjected to. This is particularly the case with law enforcement and military applications.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Figure 1:
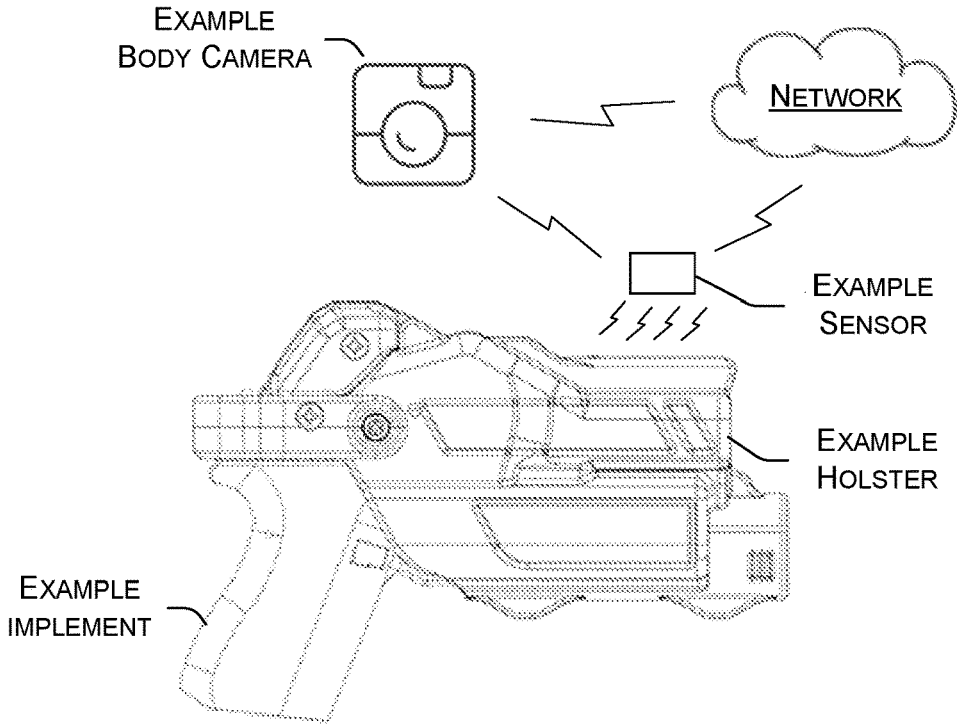
FIG. 1 shows an illustration of an example holster with a communication system, communicating with one or more remote devices, according to an implementation.
Figure 2:
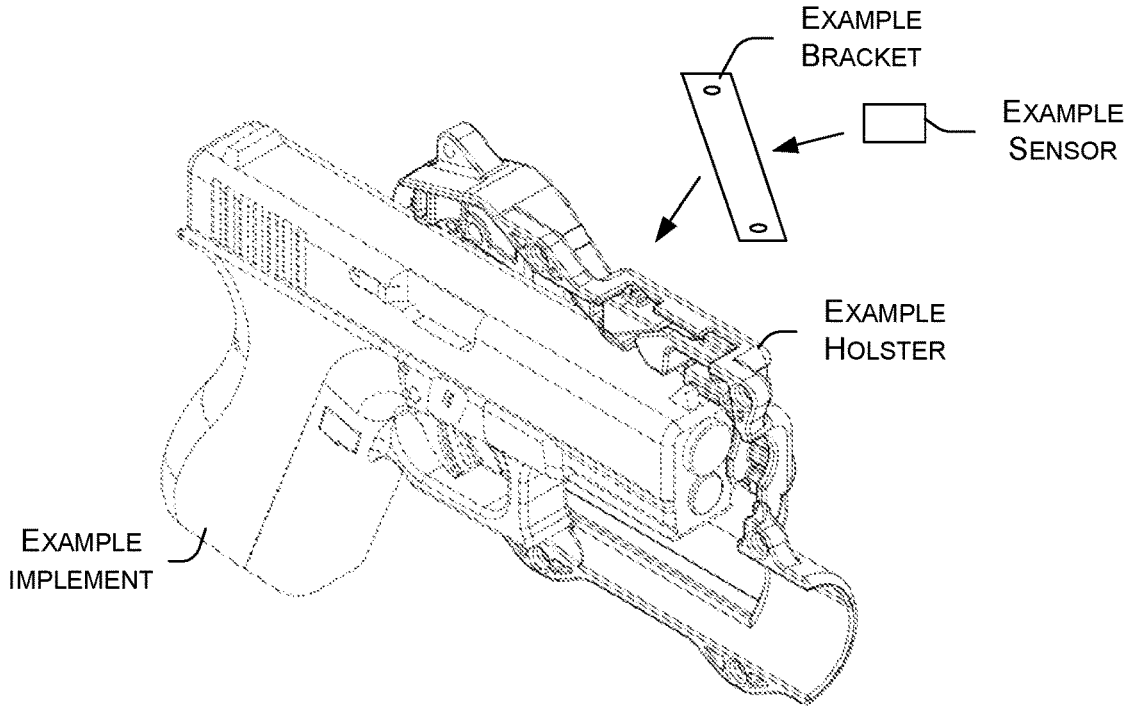
FIG. 2 shows a view of an example holster with a bracket and sensor for implementing a communication system.

Referring to FIGS. 1 and 2, body-worn cameras are required for most local and federal law enforcement agencies. Body cameras can generally be activated by the officer manually when desired. During high-risk incidents however, it is common for an officer to be overwhelmed with a threat and not have the opportunity or capacity to turn his/her body camera on.

To assist the officer, signal devices are available that can automatically turn the body camera on when the officer's weapon (or other "implement") is removed from its holster. These "signal devices" can be operated using a sensor that detects when the officer's gun has been removed from the holster, for example. The sensor may include a magnetic sensor, an optical sensor, a pressure sensor, a load cell, a compression sensor, a mechanical switch, or any of other various types of sensors. The sensor may initiate a signal to a system or network, which activates the body camera, or the sensor may activate the camera directly when it senses the removal of the weapon.

Referring to FIG. 2, brackets have been developed for attaching a sensor, which can then be attached to a holster. Many of these brackets are generic and are intended to be attached to multiple holsters and/or other objects. However, these brackets may not be capable of mounting to a desired location on a holster, and may not be capable of mounting to all holsters. For instance, some holsters include various locking mechanisms or accessory attachment points that can make it problematic to mount a sensor bracket to the holster. Additionally, the best available location for the sensor bracket may not be sufficient for the sensor to sense the weapon withdrawal to a reliable degree. Further, brackets and sensors can be damaged or knocked off of a holster during rough handling of the holster, while the user is engaged in a physical encounter with another person or object, while entering and exiting a vehicle, or during other activities.

Representative implementations of devices and techniques provide a holster for an implement (e.g., a firearm, Taser, baton, pepper spray, etc.) that includes a dedicated and integrated mounting fixture (i.e., "sensor mount") for a sensor (or a like component). For example, the sensor mount is integral to the holster rather than being coupled to the holster. The sensor mount allows a sensor to be attached to the holster body directly, at a location of greatest advantage (in terms of performance and practicality).

In some examples, the sensor mount can include an opening (hole, aperture, void, etc.) through the holster that provides direct and unimpeded access to the implement within the holster. A sensor mounted to the sensor mount may protrude through the opening of the sensor mount and into the interior of the holster.

In another example, the sensor mount can include a cover arranged to protect the sensor mounted to the holster. The cover can be durable and may be at least partly transparent or translucent to allow the user to view the sensor or indicators on the sensor if desired. In some cases, the sensor cover may include an opening for accessing a button, switch, or other actuator on the sensor.

Techniques and devices are discussed with reference to example handgun holsters as illustrated in the figures. However, this is not intended to be limiting, and is for ease of discussion and illustrative convenience. The techniques and devices discussed may be applied to a holster or to any of various cases, carriers, containers, pouches, holders, accessories, implements, tools, objects, and the like, and remain within the scope of the disclosure. For the purposes of this disclosure, the generic term "carrier" is used to indicate any or all of the above.

Further, the shape, size, and disposition of the sensor mount and components illustrated in the figures may vary to accommodate various sensor types and like objects to be docked or mounted, as well as to accommodate various applications. In alternate embodiments, fewer, additional, or alternate components may be used and/or combined to form a sensor mount assembly or a sensor mount holster having an equivalent function and operation.

Implementations are explained in more detail below using a plurality of examples. Although various implementations and examples are discussed here and below, further implementations and examples may be possible by combining the features and elements of individual implementations and examples.

Example Sensor Mount Holster Assembly

Figure 3:
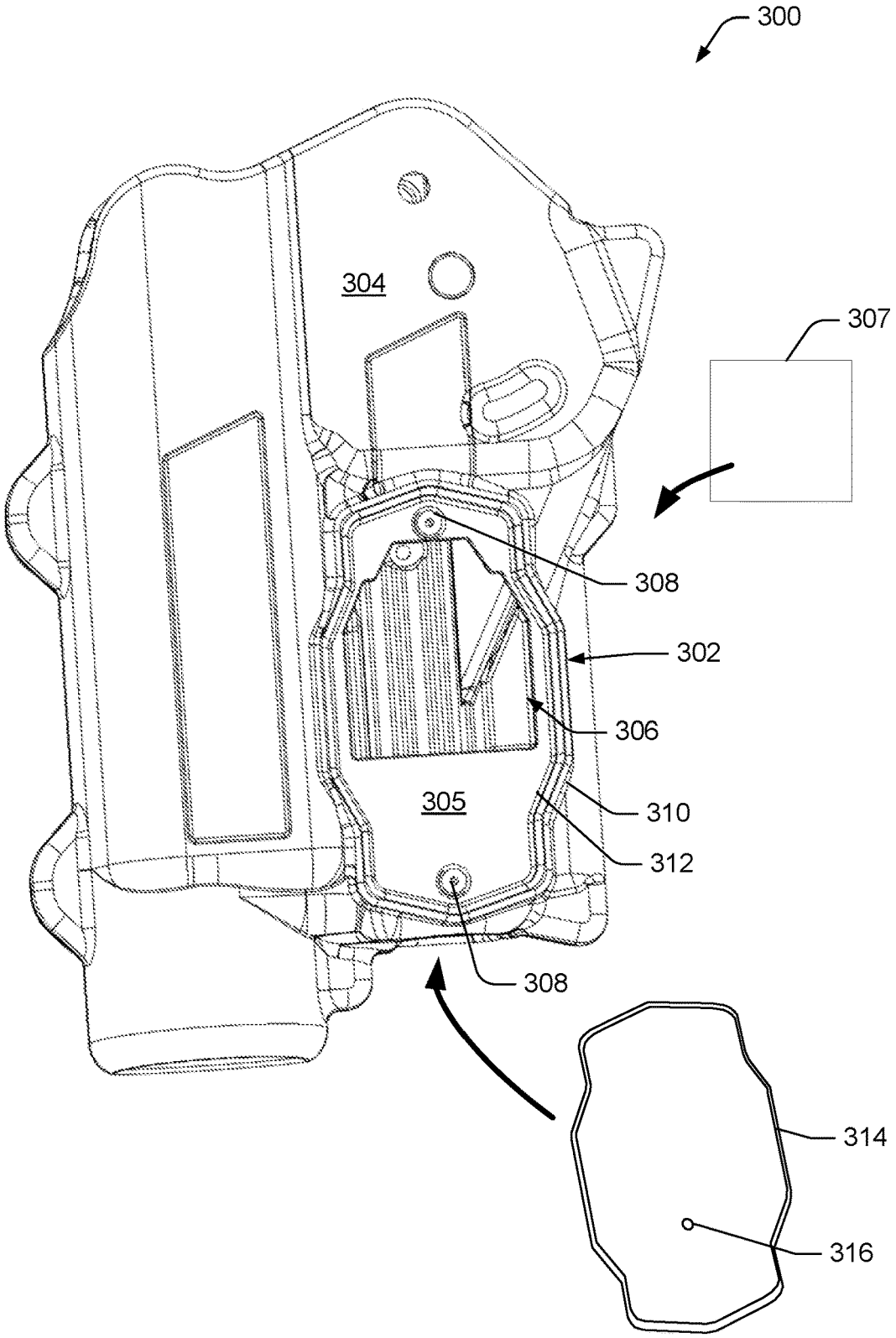
FIG. 3 shows a side perspective view of an example holster with a sensor mount, according to an implementation.

Referring to FIG. 3, in various implementations, a holster 300 for an implement (e.g., a firearm, Taser, baton, pepper spray, etc.) includes a dedicated and integrated mounting fixture or dock (i.e., "sensor mount 302") for a sensor (or a like component). The sensor mount 302 allows a sensor to be attached to the holster 300 directly, rather than with a bracket. The sensor mount 302 is integrated into the body 304 of the holster 300 as shown at FIG. 3. For example, the sensor mount 302 can be integrated into a wall of the holster body 304 or can be integrated into any desired portion of the holster 300 (e.g., side, top, bottom, front, back, etc.).

The sensor mount 302 comprises a portion of the holster 300, and is configured as an integrated fixture for a sensor to be securely mounted to the holster 300 directly, with the most advantageous location and proximity (distance and alignment) desired. For instance, the sensor mount 302 can be integrated into a wall of the holster body 304 (e.g., the sensor mount is part of the wall of the holster body 304) such that it has a low profile, and may be at least partly countersunk into the wall of the holster body 304. The low profile of the sensor mount 302 is helpful to protect the sensor from damage and unintentional removal during use.

As shown at FIG. 3, the sensor mount includes a mounting surface 305 for mounting a sensor (or other device) to the holster 300. The mounting surface 305 comprises a surface configured to receive a sensor, and may comprise a planar or substantially planar surface integral to the holster body 304. Alternately, the mounting surface 305 may be somewhat contoured or have surface features thereon (e.g., for gripping a sensor, adding friction, etc.). In an example, the mounting surface is countersunk relative to a surrounding area of the wall or body 304 of the holster 300, so that a mounted sensor is less exposed to environmental forces that would damage or remove the sensor.

In various embodiments, the sensor mount 302 includes an opening 306 (hole, aperture, void, etc.) through the mounting surface 305. The opening 306 can include a hole through the wall, top, bottom, side, etc. of the holster body 304, extending into the interior of the holster 300. In some cases, the opening 306 can have a shape that conforms to a portion (such as a sensing portion, for example) of the sensor intended to be mounted to the sensor mount 302, or another desired shape. For instance, the opening 306 may have the shape of a magnet, an optical lens, an actuator, or the like, depending on the intended sensor. In other examples, the opening 306 may have a less-specific shape or even a generic shape (e.g., elliptical, polygonal, irregular, etc.) to suit a variety of sensors.

With the opening 306, when a sensor is mounted to the sensor mount 302, a portion of the sensor can be exposed to the interior of the holster 300 (and to the weapon when it is holstered), and may also protrude through the holster body 304 and into the interior of the holster 300. This can allow the sensor to be close to the weapon (or other implement) and to avoid being obstructed by the mounting surface 305, holster body 304, or any other components. Consequently, the sensor's reliability can be optimized, without obstructions to the sensor. Alternately or optionally, an added protective layer 307 (e.g., plastic, composite, textile, alloy, mesh, etc.) can be disposed at the opening 306 so as to be between the implement and the sensor, so that the sensor is protected from damage, particularly as the implement is passed by the sensor as it is holstered and withdrawn. The protective layer 307 may cover a portion of the sensor opening 306, or the entire sensor opening 306. For example, in some cases, the protective layer 307 can be disposed on the interior side of the mounting surface 305, so as to occlude at least part of the sensor opening 306, and attached to the interior of the mounting surface with an adhesive and/or one or more fasteners. In some cases, the sensor mount 302 and/or the sensor opening 306 is positioned to be over the slide of a handgun, or another desired portion of the handgun, while the handgun is in the holster 300.

The shape of the sensor mount 302, the mounting surface 305, and/or the sensor opening 306 may be generic in some embodiments and specific to one or more particular sensors in other embodiments. Accordingly, a holster 300 with a sensor mount 302 can be custom to a particular brand and/or model of sensor, for example, and may also be custom to a particular brand and/or model of handgun (or other implement). The sensor opening 306 may be located and shaped to enhance true readings (of the implement being withdrawn from the holster 300, for example) and to minimize or eliminate false readings. Accordingly, the sensor opening 306 may include a shape that masks some areas of the sensor and/or the interior of the holster 300 while exposing other areas. In some cases, a metallic lining or other shielding material may be used with masked areas of the holster body 304 for improved performance. In other cases, the materials of the holster 300 may be selected for transparency, translucency, or opacity to the desired sensor or sensors.

The sensor mount 302 can also include one or more mounting points 308, which facilitate the attachment of a sensor to the holster 300. In some cases, the mounting points 308 are disposed at one or more locations on the mounting surface 305. For example, the mounting points 308 can include openings, threaded openings, threaded inserts, or other figured openings or recesses to accommodate various fasteners and the like. The mounting points 308 can also include fittings, fasteners, clips, snaps, and other hardware or like mechanisms. The mounting points 308 can be generically disposed at the sensor mount 302 location or can be located specific to a particular brand and/or model of sensor. In various cases a sensor can be attached (removably or permanently) to the sensor mount 302 using any combination of fasteners, adhesive, mechanical attachments, and the like.

Figure 4:
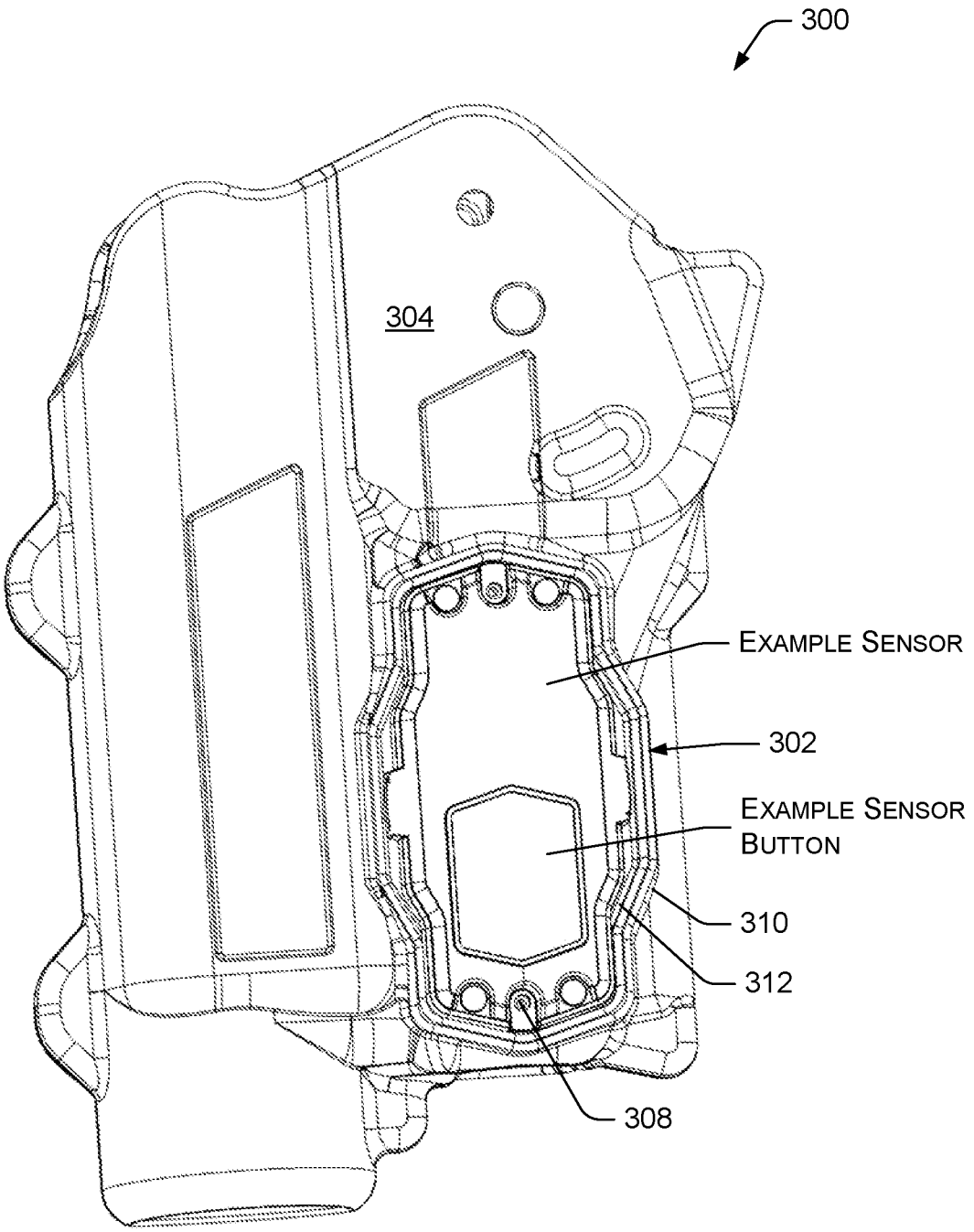
FIG. 4 shows an example holster with a sensor installed at a sensor mount, according to an implementation.
Figure 5:
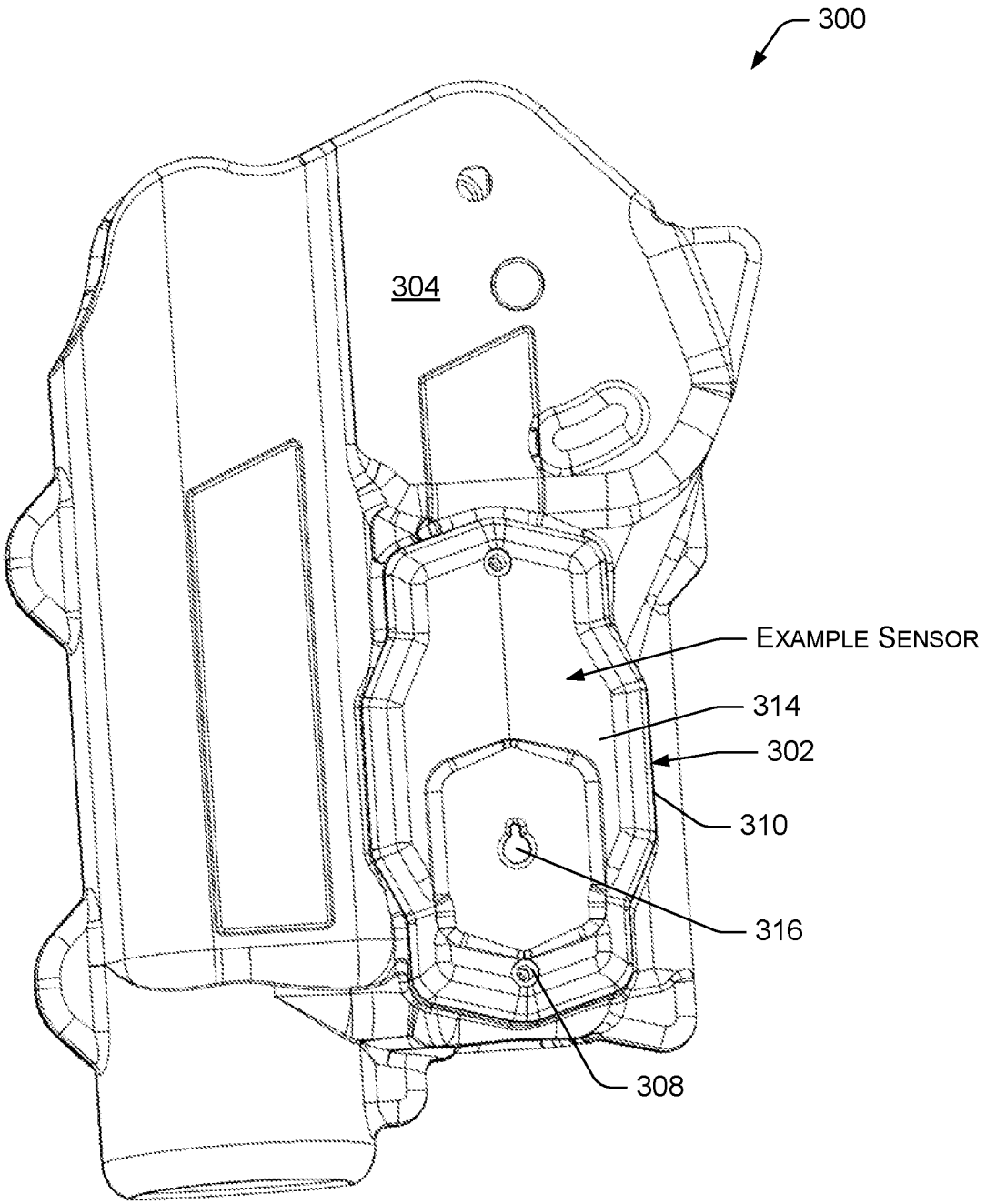
FIG. 5 shows an example holster with a sensor installed at a sensor mount and a sensor cover attached, according to an implementation.

Referring to FIGS. 3-5, the sensor mount 302 can include a sensor mount guide 310 for locating a sensor to the holster 300. In various examples, the guide 310 comprises a raised portion (e.g., ridge, ledge, lip, berm, etc.), integral to the holster 300 and the sensor mount 302 and protruding from the holster body 304 and/or mounting surface 305 that extends at least partly around a perimeter of the sensor mount 302. The guide 310 may extend around the outer periphery of the mounting surface 305 (or at least around a portion of the periphery) and may have at least a portion of the perimeter shape of the sensor to be mounted. Alternately, the guide 310 may have a more generic perimeter shape (e.g., elliptical, polygonal, irregular, etc.). The guide 310 can hold a sensor in place as well as align the sensor with the sensor opening 306 and the mounting features 308. The guide 310 also provides a protective guard-railing for the sensor, and can extend at or above a height (e.g., thickness) of the sensor, to protect the sensor from external forces, as described above. In some cases, one or more mounting points 308 are disposed at least partly on or at the guide 310.

The guide 310 (or the sensor mount 302) can include a groove 312 around the inner surface of the raised railing of the guide 310. The groove 312 comprises a furrow or channel at the inner surface or edge of the guide 310. The groove 312 may sink below the level of the mounting surface 305. In some cases, a sensor can be coupled to the sensor mount 302 of the holster 300 by sliding or snapping the sensor into the groove 312 in the guide 310. The sensor can then be fastened to the holster 300 using fasteners, adhesive, or the like, additionally if desired. In some cases, the guide 310 may extend partway around the periphery of the sensor mount 302 area, allowing a sensor to enter the sensor mount 302 from an area without a guide 310 section, and to be slideably attached to the guide 310 from the top, the bottom, or a side of the sensor mount 302. The groove 312 can assist in aligning the sensor to the sensor mount 302 and the guide 310 for an optimal orientation. In some cases the sensor is snapped into place after being slideably coupled to the guide 310. In another example, the guide 310 includes one or more features, such as snap features or the like, integrated into one or more surfaces of the guide 310, configured to secure the sensor to the sensor mount 302 surface without the need for hardware.

In some examples, the sensor mount 302 can include a cover 314 that covers all or part of a sensor while coupled to the holster 300. The cover 314 can protect the sensor from damage as well as from accidental activation (for example if the sensor includes a manual activation button, or the like).

In various examples, as shown in FIGS. 3 and 5, the cover 314 may have the same or a similar perimeter shape of the sensor mount 302 and the sensor mount guide 310. The cover 314 may engage or couple to the guide 310 to attach to the holster 300 and to align the cover 314 to the sensor. In one example, the cover 314 slides or snaps to engage with the guide 310, and may engage with the interior groove 312 in the guide 310 (or a groove on the outer surface of the guide 310) to attach to the holster 300. Further, the guide 310 may include slots, notches, recesses, or openings (or the like) on the inner, outer, and/or top surfaces of the guide 310 and the cover 314 may include tabs or protrusions, etc. (or vice versa) that engage with these features for coupling the cover 314 to the guide 310.

In case the user has a need to manually activate a sensor, the cover 314 can include an access hole or opening 316. In some cases, the access hole 316 can be small to prevent damage or unintended access to the sensor. In those cases, the hole 316 may be sized to fit the end of a handcuff key, a pen, or the like to allow the sensor button to be activated through the cover 314. In other cases, the access hole 316 may be larger, and may comprise a slot or other-shaped opening. Alternately or additionally, the cover 314 can be configured to pop off of the holster 300 when twisted or otherwise manipulated, or the cover 314 can be hinged and configured to pop open when an actuator (e.g., a tab, button, slider, etc.) is pressed, or the like. Various means can be used to open or remove the cover 314 if instant access is desired.

FIG. 4 shows a view of an example holster 300 with a sensor mount 302. In the example shown, the sensor mount 302 is positioned so as to be over the slide of a holstered handgun. This allows the sensor to be as close to the slide as possible with minimal intervening holster material between the sensor and the slide, resulting in optimal sensing of the handgun slide by the sensor and improved performance. In the example shown at FIG. 4, an example sensor is shown mounted to the sensor mount 302. The example sensor is uncovered with a manual activation button exposed. An optional cover 314 may be coupled to the sensor mount 302 (e.g., to the guide 310) to protect the sensor, as described above.

For example, FIG. 5 shows a view of an example holster 300 with a sensor mount 302, and having a cover 314. An example sensor is shown mounted to the sensor mount 302 (beneath the cover 314). The cover 314 may include a small opening 316 to manually activate the sensor through the cover 314. The sensor mount 302 or a holster 300 having a sensor mount 302 may be formed to conform to the shape and size of a particular sensor, a range of sensor products, or may be generally shaped and sized to accommodate a variety of sensors and like devices. As shown, a sensor mount cover 314 may be formed to have a same or similar shape and size (e.g., perimeter shape and size) as the sensor mount 302 and/or the sensor mount guide 310. In some examples, the cover 314 has a low profile, and protrudes minimally if at all from the surface of the holster 300. For instance, in some cases, the edges of the cover 314 can be countersunk below the surface of the holster 300. The cover 314 may be transparent or translucent so that a sensor may be viewed through the cover 314. Alternately, the cover 314 may be opaque and have a color to blend in with the holster 300. The cover 314 is comprised of a material that is transparent to signals transmitted (or received) by the sensor.

The shape and quantity of the holster 300 and related components as described and/or illustrated in the figures may vary to accommodate various applications. In alternate embodiments, fewer, additional, or alternate components may be used and/or combined, having an equivalent function and operation. Although various implementations and examples are discussed herein, further implementations and examples may be possible by combining the features and elements of individual implementations and examples. In various embodiments, the sensor mount 302 or a holster 300 with a sensor mount 302, may be added to an existing arrangement (such as existing holsters and holster mounting apparatus and assemblies, for example).

In various implementations, components of the holster assembly 300 are comprised of various plastics, composites, metals, combinations of the same, or the like. For example, the holster 300, the sensor mount 302, and/or the cover 314 may be comprised of a polyamide, a composite, or similar material. For example, the holster assembly 300 components may be injection molded, stamped, formed, or the like. In various embodiments, the holster assembly 300 components have rigidity and stability properties based on a particular material selected for the holster assembly 300 components.

For example, some materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, various metals and alloys, fiber composites, combinations of the same, and the like. In some examples, the cover 314 can be comprised of polycarbonate, or a like material, for durability and transparency. Additionally, in some embodiments, the stability properties are also based on a thickness of the holster assembly 300 components.

The illustrations of FIGS. 1-5 are not intended to be limiting. In the various example embodiments illustrated in FIGS. 1-5, the location and position of the components, attachment mechanisms, and the like are for example only. Other locations and positions are contemplated and are within the scope of this disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a holster assembly 300 may be implemented as a stand-alone device or as part of another system (e.g., integrated with other components, such as a duty belt).

Various implementations and examples are discussed herein, and further implementations and examples may be possible by combining the features and elements of individual implementations and examples.

CONCLUSION

Although the implementations of the disclosure have been described in language specific to structural features and/or methodological acts, it is to be understood that the implementations are not necessarily limited to the specific features or acts described.

The invention claimed is:

1. A holster for an implement, comprising:
- a holster body adapted to receive and to encase an implement within the holster body;
- a sensor mount integral to a wall of the holster body, the sensor mount being an inbuilt part of the wall of the holster body, the sensor mount including:
  - a mounting surface for mounting a sensor directly to the holster body;
  - an opening through the mounting surface to an interior of the holster body; and
  - a sensor mount guide comprising a raised ridge protruding from the holster body and extending at least partially around a periphery of the mounting surface.

2. The holster of claim 1, further comprising one or more mounting points for fixing the sensor to the sensor mount.

3. The holster of claim 2, wherein the one or more mounting points are disposed at the mounting surface.

4. The holster of claim 1, further comprising a removable cover configured to cover at least a portion of the sensor mount.

5. The holster of claim 4, wherein the cover includes a hole through the cover for accessing the sensor through the cover.

6. The holster of claim 4, wherein the cover is configured to engage with the sensor mount guide for attaching the cover to the sensor mount.

7. The holster of claim 4, wherein the cover is at least partly transparent or translucent.

8. The holster of claim 1, wherein the opening is configured to allow a portion of the sensor to be exposed to an interior of the holster body.

9. The holster of claim 1, wherein the sensor mount guide includes a groove on an inside surface of the sensor mount guide.

10. The holster of claim 9, wherein the groove is configured to engage the sensor for aligning the sensor with the opening.

11. The holster of claim 1, wherein the sensor mount guide includes one or more features integral to the guide, configured to secure the sensor to the sensor mount without hardware.

12. The holster of claim 1, wherein the sensor mount guide comprises a ridge integral to the sensor mount and protruding from the holster body.

13. The holster of claim 1, wherein the sensor mount guide has at least a portion of a perimeter shape of the sensor.

14. A holster for an implement, comprising:
- a holster body adapted to receive and to carry an implement;
- a sensor mount integral to the holster body, the sensor mount including:
  - a mounting surface for mounting a sensor to the holster;
  - an opening through the mounting surface to an interior of the holster body; and
  - a sensor mount guide comprising a raised portion extending at least partially around a periphery of the mounting surface; and
- a removable cover configured to be externally coupled to the sensor mount and to enclose the sensor mount.

15. The holster of claim 14, further comprising a protective layer arranged at least partly over the opening, so as to be disposed between the sensor and the implement when holstered.

16. The holster of claim 14, wherein the mounting surface is countersunk relative to a surrounding area of the holster body.

17. The holster of claim 14, wherein the opening is configured to allow at least a portion of the sensor to protrude into an interior of the holster body.

18. The holster of claim 14, wherein the sensor mount guide protrudes from the holster body above a height of the sensor and comprises a protective guard-railing configured to protect the sensor from external forces.

19. The holster of claim 14, wherein the cover has a perimeter shape of the sensor mount guide.

20. A holster for an implement, comprising:
- a holster body adapted to receive and to encase an implement within the holster body;
- a sensor mount integral to the holster body, the sensor mount comprising part of a wall of the holster body, the sensor mount including:
  - a mounting surface for mounting a sensor to the holster, the mounting surface being countersunk into the wall of the holster body;
  - an opening through the mounting surface to an interior of the holster body;
- a protective layer disposed over at least a portion of the opening; and
  - a sensor mount guide comprising a raised portion extending at least partially around a periphery of the mounting surface; and
- a removable cover configured to be externally coupled to the sensor mount and to cover at least a portion of the sensor mount, the cover including first features arranged to engage with second features of the sensor mount guide to removably couple the cover to the sensor mount.

* * * * *